United States Patent [19]

Antos et al.

[11] Patent Number: 4,899,966

[45] Date of Patent: Feb. 13, 1990

[54] RACK CLIP FOR ANODIZING AND PAINTING

[75] Inventors: Thomas Antos, Gig Harbor, Wash.; Jon Rosner, Chicago, Ill.; David J. Wirth, Seattle, Wash.

[73] Assignee: The Boeing Company, Seattle, Wash.

[21] Appl. No.: 269,580

[22] Filed: Nov. 10, 1988

[51] Int. Cl.[4] ..... C25D 17/06

[52] U.S. Cl. ..... 248/74.4; 248/316.5; 204/297 R; 204/297 W; 269/254 R; 24/557; 24/567

[58] Field of Search ..... 248/65, 67.5, 72, 74.1, 248/74.2, 74.4, 74.5, 214, 231.5, 302, 309.1, 316.1, 316.5, 316.6, 324, 231.8, 316.7; 204/285, 286, 297 R, 297 W; 269/254 R; 24/502, 504, 510, 513, 533, 547, 548, 557, 549, 565, 568, 567

[56] References Cited

U.S. PATENT DOCUMENTS

| | | | |
|---|---|---|---|
| 441,892 | 12/1890 | Possons | 204/297 W |
| 751,406 | 2/1904 | Parshall | 248/302 |
| 1,105,855 | 8/1914 | Smith | 248/231.5 |
| 1,267,694 | 5/1918 | Ralston | 24/549 |
| 1,750,807 | 3/1930 | Lichtman . | |
| 1,798,651 | 3/1931 | Berry, Jr. | 24/549 |
| 1,979,528 | 11/1934 | Bruce | 269/254 R |
| 2,516,760 | 7/1950 | Doran | 248/214 |
| 2,603,849 | 7/1952 | Epperson | 24/510 |
| 3,429,786 | 2/1969 | Kubik | 204/297 W |
| 3,642,147 | 2/1972 | Voorhies . | |
| 4,591,420 | 5/1986 | Van Horn . | |

FOREIGN PATENT DOCUMENTS

| | | | |
|---|---|---|---|
| 470681 | 1/1929 | Fed. Rep. of Germany | 204/297 W |
| 2711337 | 6/1978 | Fed. Rep. of Germany | 24/504 |
| 773799 | 5/1957 | United Kingdom . | |

OTHER PUBLICATIONS

Preston, John J. "Plating Jigs", Metal Industry, Mar. 11, 1955, pp. 189–191.

*Primary Examiner*—Ramon O. Ramirez
*Assistant Examiner*—Robert A. Olson
*Attorney, Agent, or Firm*—Bruce A. Kaser

[57] ABSTRACT

The invention is an improved clip for holding workpieces to racks during alodining, anodizing and/or painting operations. The clip is constructed of a torsion spring having a central coiled portion and laterally extending tines interconnected by the coil. The coil is biased so that the ends of the tines are normally forced toward each other for gripping a workpiece inbetween their ends. A handle is connected to the coil and extends laterally away therefrom. This may be rotated in a manner so as to oppose the coil's bias, thus causing the tines' ends to spread apart for releasing the workpiece.

4 Claims, 2 Drawing Sheets

Fig. 1
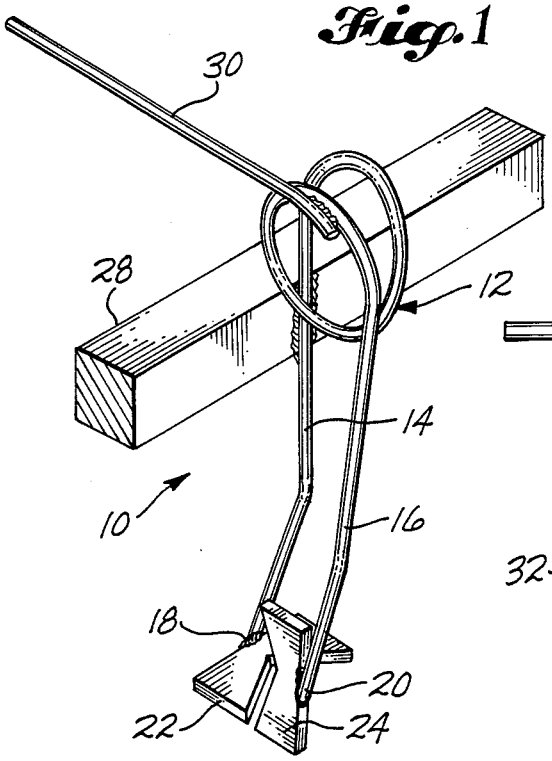
Fig. 2
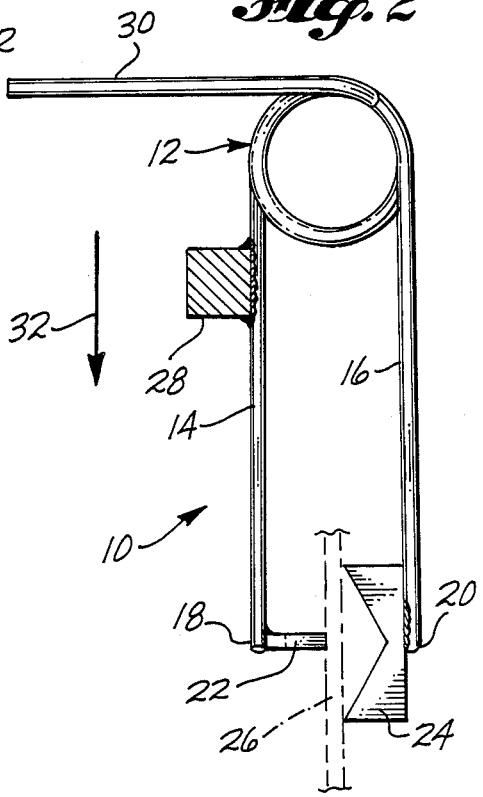
Fig. 3
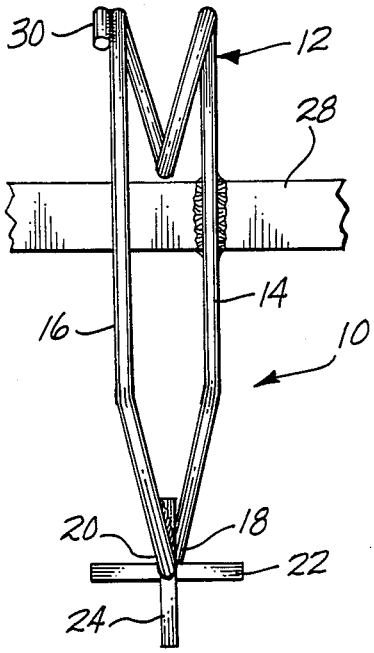
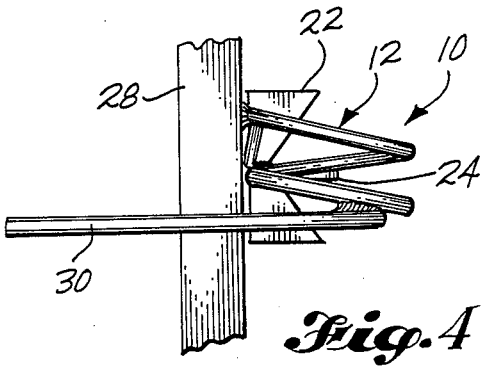
Fig. 4

10
10
10
10
10
10
10
10
34
44
46
48
36
42
38
40

RACK CLIP FOR ANODIZING AND PAINTING

DESCRIPTION

1. Technical Field

This invention relates to racking systems which hold parts during anodizing and painting operations. Specifically, the invention relates to gripping devices for holding workpieces on a rack during such operations.

2. Background Art

In order to reduce the labor costs associated with finishing small aluminum parts, aerospace companies have been developing rack systems which can hold these parts during alodining or anodizing and painting operations. The current method for carrying out these operations involves first racking parts for alodining or anodizing, as the case may be, and then unracking them for painting in a separate operation. Thus far, no one has developed a rack system that can efficiently hold both larger and smaller parts during both operations. Having such a system would, of course, eliminate extra handling of parts between the alodining or anodizing step and the painting step.

The racking system currently used in the aerospace industry, although having the above-noted drawback, generally performs quite well when processing larger parts. However, this system loses its effectiveness as part size decreases, and particularly, when part size decreases to below a maximum dimension of approximately 15 inches. This is because in the current system the parts are held in the rack by two to four relatively large clipping devices. As the part size decreases, the clips therefore take up a larger percentage of the rack which consequently increases the number of racks that must be used in processing parts.

For example, the Boeing Company, who owns an interest in the invention disclosed herein, is projecting a need to alodine or anodize and paint 5 to 10 million aluminum parts per year, with approximately 90% of these having a maximum dimension of less than 12 inches. This has created a need to improve the current racking system so that more parts can be mounted to an individual rack.

The present invention represents an improvement in current racking systems in that it has an improved clipping device for holding parts on the rack.

DISCLOSURE OF THE INVENTION

The present invention is an improved clip which is mounted in large numbers to a rack or frame for holding parts during an alodining, anodizing or painting operation. The clip is made of a torsion spring that has a central, coiled portion which interconnects first and second elongated tines. One of the tines is fixedly connected directly to the rack. Both tines extend laterally away from the coiled portion in generally the same direction. Their outer ends or termini are positioned directly opposite each other and the coiled portion is biases so that the termini are normally forced toward each other. This provides a gripping action for holding a workpiece on the frame.

The clip further has an elongated handle that also extends laterally outwardly from the spring's coiled portion. The handle is connected directly to the coiled portion in a manner so that rotational movement thereof creates an uncoiling movement opposing the normal bias of the coiled portion. This, in turn, causes the tines' termini to spread apart for easy release of the workpiece held thereby.

An advantage of the present invention is that its small size permits more clips to be placed on a given rack, and a single clip can hold a part which means more parts can also be placed on the rack. It is estimated the invention improves part racking density from 2 to 4 times higher than the current racking system for small sized parts whose maximum dimension is not greater than 15 inches. For a given quantity of parts to be processed, the total number or racks which must be sent through a painting operation, for example, can be reduced proportionately. Basically, fewer racks, reduces the overall expenditure required to purchase racks, reduces the need to have expensive material handling equipment, and also reduces facility requirements. With regard to the latter, implementation of the invention will reduce the number of paint booths required to process a given number of parts. The invention also reduces labor costs in that less labor is required to handle a reduced number of racks.

BRIEF DESCRIPTION OF THE DRAWINGS

In the drawings, like reference numerals refer to like parts throughout the various views, and:

FIG. 1 is a pictorial view of a clip constructed in accordance with the preferred embodiment of the invention;

FIG. 2 is a side elevational view of the clip shown in FIG. 1;

FIG. 3 is a frontal view of the clip shown in FIGS. 1 and 2;

FIG. 4 is a top plan view thereof; and

BEST MODE FOR CARRYING OUT THE INVENTION

Figure 5:
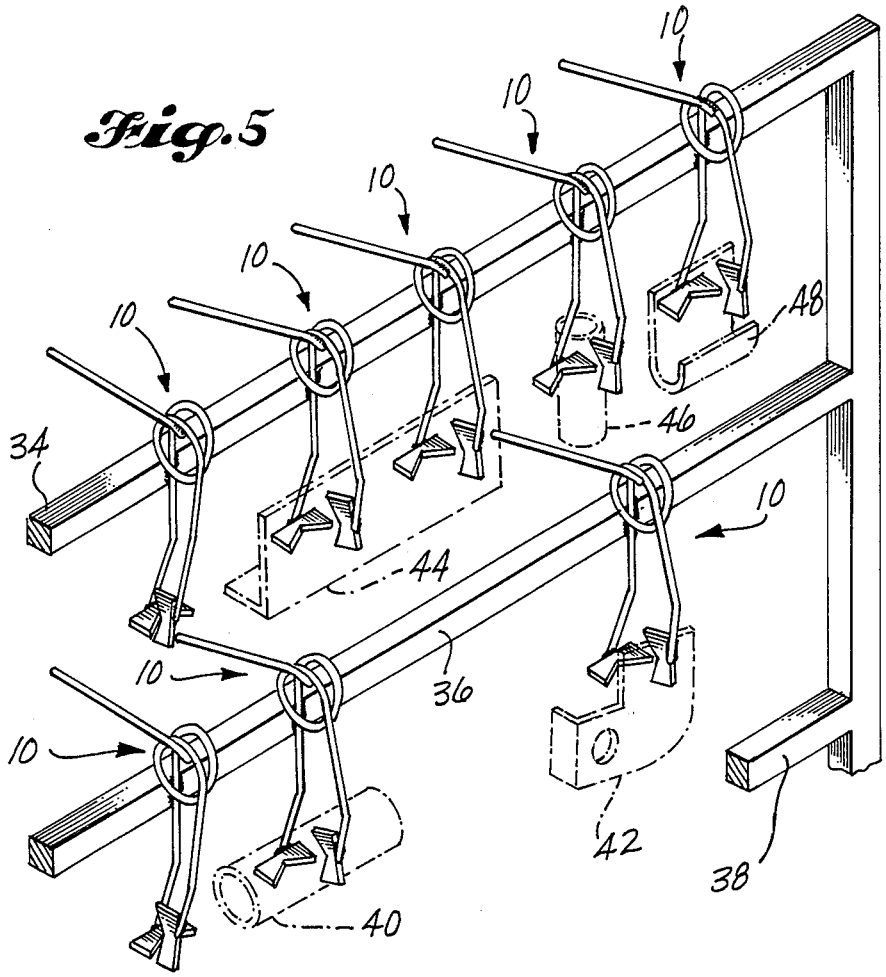
FIG. 5 is a pictorial view of a rack or frame and shows a plurality of clips mounted thereto.

In the drawings, and referring first to FIG. 1, therein is shown at 10 a clip constructed in accordance with a preferred embodiment of the invention. The clip has a central coiled portion 12 which interconnects first and second tines 14, 16. The coiled portion 12 is biased in a manner so that spring tension therein forces the tines 14, 16 toward each other. The tines' ends or termini 18, 20 have contacts 22, 24 which grip a workpiece. Referring to FIG. 2, this is best illustrated by dashed lines 26.

One of the tines 14 is fixedly connected to a frame or rack crossbar 28. Such attachment may be made by welding or any other suitable means. Preferably, the clip 10 is made of an electrically conductive material such as an electrically conductive titanium alloy. The attachment of tine 14 to crossbar 28, however it is done, should provide a good electrical contact between the clip 10 and crossbar 28.

Also, welded to coiled portion 12 is a laterally extending handle 30. Moving this handle downwardly in the direction indicated by arrow 32 in FIG. 2 opposes the bias of coiled portion 12 and thus spreads contacts 22, 24 apart. This, of course, releases any workpiece held therebetween.

As shown in FIG. 5, a plurality of clips 10 constructed in accordance with the invention would be distributed across the crossbars 34, 36 of a given rack 38. In this manner, a number of workpieces or parts 40, 42, 44, 46, 48 could be mounted to the rack 38 for alodining, anodizing and/or painting operations.

Having thus described a preferred embodiment for carrying out the invention, it is to be understood that the clip 10 described above could be modified in certain ways without departing from the spirit and scope of the invention disclosed herein. Any patent protection which is due applicants in this case is therefore not to be limited by the above description but rather is to be limited only by the patent claim or claims which follow, the interpretation of which is to be made in accordance with the established doctrines of patent claim interpretation.

What is claimed is:

1. A clip for holding a workpiece during an alodining, anodizing and painting operation, and like operations, said clip comprising:

a single, electrically conductive wire-like member, said member having a coiled portion and first and second elongated tine portions, said tine portions extending away from said coiled portion in generally the same direction and in a manner so that the termini thereof are normally positioned opposite each other, with each terminus having a contact portion, said coiled portion being biased so that said tine portions and their termini are normally forced toward each other for gripping a workpiece between the contact portions therof; and an elongated handle member, welded to said coiled portion of said electrically conductive member, said handle member extending outwardly away from said coiled portion, said handle member being moveable about said coiled portion in a manner so as to oppose the bias of said coiled portion, to cause said termini to spread apart for releasing said workpiece.

2. A clip for holding a workpiece during an alodining, anodizing and painting operation, and like operations, said clip comprising:

an electrically conductive member having a coiled portion and first and second elongated tine portions, said tine portions extending laterally away from said coiled portion in generally the same direction and in a manner so that the termini thereof are normally positioned opposite each other, with each terminus having a contact portion, said coiled portion being biased so that said tine portions and their termini are normally forced toward each other for gripping a workpiece between the contact portions thereof, and wherein each of said contact portions has a contact edge facing said workpiece which recedes away from said workpiece in a manner so that said edge contacts said workpiece substantially only at opposite ends of said contact edge, said contact edge of one contact portion being rotated 90° with respect to the other.

3. In combination, a clip and frame for use in an alodining, anodizing or painting operation, and like operations, comprising:

an electrically conductive frame member;

an electrically conductive clip member having a coiled portion and first and second elongated tine portions, said tine portions extending downwardly away from said coiled portion in a manner so that the termini thereof are positioned opposite each other below said frame member, with each terminus having a contact portion, said coiled portion being biased so that said termini are normally forced toward each other for gripping a workpiece between the contact portions thereof, and wherein one of said tine portions is fixedly connected to said frame member in a manner so that an electrically conductive path is defined between said clip member and said frame member, said coiled portion being positioned substantially above said frame member; and an elongated handle member fixedly connected to said coiled portion of said clip member, said handle member extending away from said coiled portion and over said frame member, in a manner so that said handle member is movable downwardly in a direction toward said frame member to create a torsional force opposing the bias of said coiled portion, such force causing said termini and their contact portions to spread apart for releasing said workpiece.

4. The combination set forth in claim 3, wherein each of said contact portions has a contact edge facing said workpiece which recedes away from said workpiece in a manner so that said edge contacts said workpiece substantially only at opposite ends of said contact edge, said contact edge of one contact portion being rotated 90° with respect to the other.

* * * * *